US009346076B1

(12) United States Patent
Ford

(10) Patent No.: US 9,346,076 B1
(45) Date of Patent: May 24, 2016

(54) FINE-LINE APPLICATOR DEVICE

(71) Applicant: David Ford, San Leandro, CA (US)

(72) Inventor: David Ford, San Leandro, CA (US)

( * ) Notice: Subject to any disclaimer, the term of this patent is extended or adjusted under 35 U.S.C. 154(b) by 0 days.

(21) Appl. No.: 14/753,428

(22) Filed: Jun. 29, 2015

(51) Int. Cl.
*B05C 17/005* (2006.01)
*B43K 8/14* (2006.01)
*B43K 23/08* (2006.01)

(52) U.S. Cl.
CPC ..... *B05C 17/00516* (2013.01); *B43K 8/14* (2013.01); *B43K 23/08* (2013.01)

(58) Field of Classification Search
CPC combination set(s) only.
See application file for complete search history.

(56) References Cited

U.S. PATENT DOCUMENTS 954,133 A * 4/1910 Reed ..... B43K 7/12 15/172
4,002,182 A * 1/1977 Michel ..... A45D 40/26 401/202
6,905,277 B2 * 6/2005 Saito ..... A45D 34/042 401/270
7,175,360 B2 * 2/2007 Zhang ..... A45D 34/04 401/186
7,229,229 B2 * 6/2007 Wang ..... B05B 11/047 401/262
7,281,876 B2 * 10/2007 Kwon ..... A45D 34/04 401/262

* cited by examiner

*Primary Examiner* — David Walczak
(74) *Attorney, Agent, or Firm* — Larry D. Johnson

(57) ABSTRACT

A fine-line applicator device creates an air-tight seal on a container of a substance, while preventing clogging in an applicator tip. The device includes a first cap, a nozzle protruding from the cap, a second cap engaging the nozzle, a hollow-bore needle protruding from the second cap, an end cap engaging the second cap, and an elongated member protruding from the end cap, such that the elongated member can be inserted into the hollow-bore needle. When the device is in a closed position, the elongated member occupies the interior chamber of the hollow-bore needle while the end cap engages the second cap to form a substantially air-tight seal, and when the end cap is removed from the second cap, the elongated member vacates the interior chamber of the hollow-bore needle to allow flow of a substance from the container through the needle.

3 Claims, 1 Drawing Sheet

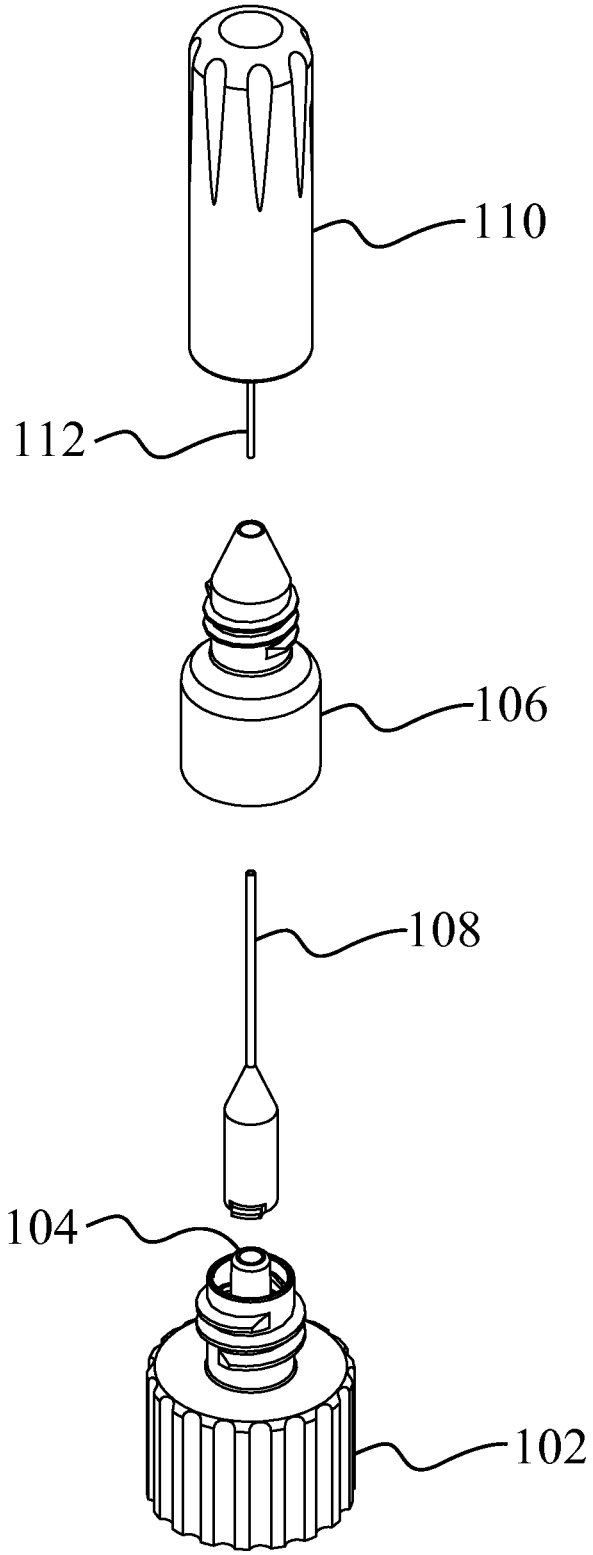
110
112
106
108
104
102

FINE-LINE APPLICATOR DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present device relates to the field of applicator tips for precise distribution and placement of substances such as paints, adhesives, and coatings.

BACKGROUND INFORMATION AND DISCUSSION OF RELATED ART

Many artistic and industrial fields require the precise placement and distribution of substantially liquid, semi-liquid, or colloidal substances on a surface. For example, a person may want to apply a thin line of paint or adhesive to a surface. This can be accomplished by channeling the substance through a very narrow tube or a hollow-bore needle.

In addition, many of these substances are formulated to be quick-drying. Although this characteristic helps to prevent smudging and other defects after application, it makes the substance highly susceptible to drying out in its container if not sealed up properly after use. In the case of applicator tips with narrow interior cross-sections, such as hollow-bore needles, the relatively small amount of material that remains in the tip after application can easily dry out, thus clogging the tip. Often, a clogged tip cannot be cleared, and must be replaced.

What is needed is a simple device that can create an air-tight seal on a container of a substance, while also preventing clogging in an applicator tip.

The foregoing information reflects the current state of the art of which the present inventor is aware. Reference to, and discussion of, this information is intended to aid in discharging Applicant's acknowledged duty of candor in disclosing information that may be relevant to the examination of claims to the present invention. However, it is respectfully submitted that none of the above information discloses, teaches, suggests, shows, or otherwise renders obvious, either singly or when considered in combination, the invention described and claimed herein.

SUMMARY OF THE INVENTION

The fine-line applicator device of this invention provides a device that can create an air-tight seal on a container of a substance, while also preventing clogging in an applicator tip. The inventive device includes a first cap capable of engaging with a container, the cap having an exterior surface and an interior surface; a nozzle protruding from the surface of the cap; a second cap capable of selectively engaging with the nozzle, the second cap having an exterior surface and an interior surface; a hollow-bore needle having an interior chamber protruding from the exterior surface of the second cap; an end cap capable of selectively engaging with the second cap, the end cap having an exterior surface and an interior surface; and an elongated member protruding from the interior surface of the end cap, such that the elongated member can be inserted into the interior chamber of the hollow-bore needle. When the applicator device is in a closed position, the elongated member occupies the interior chamber of the hollow-bore needle while the end cap engages with the second cap to form a substantially air-tight seal, and when the end cap is removed from the second cap, the elongated member vacates the interior chamber of the hollow-bore needle to allow flow of a substance from the container through the hollow-bore needle.

It is therefore an object of the present invention to provide a new and improved device that can create an air-tight seal on a container of a substance.

It is another object of the present invention to provide a new and improved device preventing clogging in an applicator tip.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawing wherein:

FIG. 1 depicts an exploded perspective view of an embodiment of the present device.

DETAILED DESCRIPTION OF THE INVENTION

FIG. 1 depicts an exploded perspective view of an embodiment of the present device. A cap 102 can selectively engage with the mouth of a bottle, jar, tube, or any other known and/or convenient container. In some embodiments, a cap 102 can engage with a container by a threaded connection, as shown in FIG. 1, but in other embodiments can have a snap-fit, friction-fit, adhesive, welded, or any other known and/or convenient mechanism. In some embodiments, a cap 102 can be integrated with a container. In some embodiments, a cap 102 can have exterior texturing to facilitate handling. As shown in FIG. 1, a cap 102 can have a substantially circular cross-section, but in other embodiments can have any other known and/or convenient geometry. In some embodiments, a cap 102 can be comprised of plastic, rubber, polymer, metal, or any other known and/or convenient material.

A cap 102 can have a nozzle 104 that can protrude outward from the top surface of a cap 102. In some embodiments, a nozzle 104 can protrude substantially perpendicularly from and substantially along the longitudinal axis of the top surface of a cap 102, but in other embodiments can protrude at any other known and/or convenient angle relative to the top surface of a cap 102. In other embodiments, a nozzle 104 can be located at any other known and/or convenient location on the top surface of a cap 102. A nozzle 104 can be integrated with or affixed to a cap 102. As shown in FIG. 1, a nozzle 104 can have a substantially cylindrical geometry, but in other embodiments can have a conical geometry or any other known and/or convenient geometry. In some embodiments, a nozzle 104 can have threading at its distal tip to selectively engage with a second cap 106. In other embodiments, nozzle 104 can have a smooth, textured, or any other known and/or convenient type of exterior surface.

A second cap 106 can selectively engage with a nozzle 104. In some embodiments, a second cap 106 can engage with a nozzle 104 by a threaded connection, as shown in FIG. 1, but in other embodiments can have a snap-fit, friction-fit, adhesive, or any other known and/or convenient mechanism. In some embodiments, a second cap 106 can have exterior texturing to facilitate handling. As shown in FIG. 1, a second cap 106 can have a substantially circular cross-section and be substantially cylindrical or conical, but in other embodiments can have any other known and/or convenient geometry. In some embodiments, a second cap 106 can be comprised of plastic, rubber, polymer, metal, or any other known and/or convenient material.

A hollow-bore needle 108 can protrude outward from the top surface of a second cap 106. In some embodiments, a needle 108 can protrude substantially perpendicularly from and substantially along the longitudinal axis of the top surface of a second cap 106, but in other embodiments can protrude at any other known and/or convenient angle relative to the top surface of a second cap 106. In other embodiments, a needle 108 can be located at any other known and/or convenient location on the top surface of a second cap 106. A needle 108 can be integrated with or affixed to a second cap 106. As shown in FIG. 1, a needle can have a substantially cylindrical geometry, but in other embodiments can have a conical geometry or any other known and/or convenient geometry. In alternative embodiments, a needle 108 can have a substantially flat tip, a substantially rounded tip, a beveled tip, a pointed tip, or any other known and/or convenient tip geometry. In other embodiments, a needle 108 can have a smooth, textured, or any other known and/or convenient type of exterior surface.

An end cap 110 can have an elongated member 112 protruding substantially perpendicularly from the interior of and substantially along the longitudinal axis of an end cap 110. In some embodiments, an elongated member 112 can be a wire comprised of metal, but in other embodiments can be a polymer or any other known and/or convenient material. In some embodiments, an elongated member 112 can have a substantially circular cross-sectional geometry and dimensions such that an elongated member can be inserted into a needle 108, but in other embodiments can have any other known and/or convenient geometry.

An end cap 110 can selectively engage with a second cap 106 by a friction-fit connection, as shown in FIG. 1, but in other embodiments can have a snap-fit, threaded, adhesive, or any other known and/or convenient mechanism. In other embodiments, an end cap 110 can selectively engage with a needle 108 with a friction it connection or any other known and/or convenient mechanism. In some embodiments, an end cap 110 can have exterior texturing to facilitate handling. As shown in FIG. 1, an end cap 110 can have a substantially circular cross-section and be substantially cylindrical or conical, but in other embodiments can have any other known and/or convenient geometry. In some embodiments, an end cap 110 can be comprised of plastic, rubber, polymer, metal, or any other known and/or convenient material.

In some embodiments, the present device can be affixed to or integrated with a container. However, in other embodiments, the present device can be removably attached to a container and thus interchangeable and replaceable.

In a closed position, an elongated member 112 can occupy the interior chamber of a hollow-bore needle 108, while an end cap 110 can selectively engage with a second cap 106 to form a substantially air-tight seal. A user then removes an end cap 110, extracting an elongated member 112 to vacate the interior chamber of a hollow-bore needle 108 and allow flow of a substance through a needle 108. When finished applying a substance, a user replaces an end cap 110, inserting an elongated member into a needle 108. Keeping a container properly sealed and maintaining a clear passageway through a needle 108 will prevent drying out of the substance and clogging of a needle 108.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An applicator device consisting of;

a first cap capable of selectively engaging and disengaging with a container, said first cap having an exterior surface and an interior surface and an opening therethrough adapted for fluidly connecting to the container;

a nozzle protruding from said exterior surface of said first cap;

a second cap capable of selectively engaging with said nozzle, said second cap having an exterior surface and an interior surface, a lower end for releasably engaging said nozzle and an upper end having a conical portion with an opening extending through a tip end thereof;

a hollow-bore needle having an interior chamber and having a wide lower portion positioned within said second cap and a thinner upper portion extending through said opening in said tip end; said first cap, said nozzle, said second cap and said needle defining a substantially linear flow path from said opening in the first cap to the bore in said needle;

an end cap capable of selectively engaging with said second cap, said end cap having an exterior surface and an interior surface; and an elongated member protruding from said interior surface of said end cap, such that said elongated member can be inserted into said interior chamber of said hollow-bore needle, wherein when said applicator device is in a closed position, said elongated member occupies said interior chamber of said hollow-bore needle while said end cap engages with said second cap to form a substantially air-tight seal, and when said end cap is removed from said second cap, said elongated member vacates said interior chamber of said hollow-bore needle to allow flow of a substance from said container through said hollow-bore needle.

2. The applicator device of claim 1 wherein said nozzle bears threading to selectively engage said second cap.

3. The applicator device of claim 1 wherein said second cap bears threading to selectively engage said end cap.

* * * * *